United States Patent [19]

Thomas

[11] Patent Number: 4,781,344

[45] Date of Patent: Nov. 1, 1988

[54] AIRPLANE KITE

[76] Inventor: Ralph B. Thomas, 3645 Audrey Dr., Titusville, Fla. 32796

[21] Appl. No.: 937,364

[22] Filed: Dec. 3, 1986

[51] Int. Cl.[4] ..... A63H 27/08
[52] U.S. Cl. ..... 244/154
[58] Field of Search ..... 244/154

[56] References Cited

U.S. PATENT DOCUMENTS

| | | | |
|---|---|---|---|
| 2,136,717 | 11/1938 | Waldock | 244/154 |
| 2,298,400 | 10/1942 | McCoy | 244/154 |
| 2,493,704 | 1/1950 | Tomczyk et al. | 244/154 |
| 2,778,154 | 1/1957 | Dauwe | 244/154 |
| 3,366,354 | 1/1968 | Sterba | 244/154 |
| 3,912,204 | 10/1975 | Wheat et al. | 244/154 |

FOREIGN PATENT DOCUMENTS

| | | | |
|---|---|---|---|
| 1215842 | 4/1960 | France | 244/154 |

*Primary Examiner*—Galen Barefoot
*Assistant Examiner*—Rodney Corl
*Attorney, Agent, or Firm*—N. J. Aquilino

[57] ABSTRACT

An airplane kite shaped to resemble a jet powered airplane, formed of lightweight plastic foam material, or the like, having a fuselage and vertical stabilizer shaped to resemble the side view of a jet airplane, and a wing and horizontal stabilizer both shaped in the form of a top view of a swept back jet airplane.

The horizontal and vertical stabilizers are enlarged relative to the normal dimensions of actual jet powered aircraft and the stabilizers and wing are so positioned to provide lift and flight stability when flown from a tether attached to the airplane kite.

10 Claims, 1 Drawing Sheet

AIRPLANE KITE

BACKGROUND OF THE INVENTION

The present invention relates to kites, and more particularly to tethered aerodynamically shaped kites in the form of a conventional jet powered airplane.

Most kites are made of a lightweight body and frame having an air reaction surface disposed at a relatively high angle of attack.

All kites regardless of shape, form or structural material must maintain this positive angle of attack, defined as the angle between the longitudinal axis of the aircraft and the horizon, into the wind to achieve sustained flight. To establish this positive angle of attack, most kite designs tether a string to a bridle or string harness, and is some designs use a tail attached to the aft end of the kite.

In order to more closely simulate the flying of an airplane, various types of airplane kite structures have been made. Examples of kites having shapes simulating aircraft are shown in the patents to Kellogg (U.S. Pat. No. 1,927,835), Stoney et al (U.S. Pat. No. 2,063,961), Taylor (U.S. Pat. No. 2,097,538), Ventre (U.S. Pat. No. 3,284,033), Stratton (U.S. Pat. No. 3,758,057) and Wheat et al (U.S. Pat. No. 3,912,204), among others.

SUMMARY OF THE INVENTION

The present invention is an innovative airplane kite design formed of three members. The first member forms the body of the airplane kite and includes a fuselage and a large vertical stabilizer which are shaped to resemble the side view of a modern jet liner. The fuselage includes two slots to receive a wing and horizontal stabilizer. The second member is a wing, shaped in the form of a top view of a modern swept wing jet, and the third member is a horizontal stabilizer also shaped in the form of a swept back top view of a jet. Preferably, the airplane kite is constructed of a lightweight, rigid, flat, expanded polystyrene or other plastic foam material. The jet airplane design features are functional to maximize buoyancy, lift, and lateral and longitudinal stability. The airplane kite is completely dependent upon the natural horizontal air flow, or wind, to ascend vertically from the ground surface using a string tether. To accomplish this, while maintaining the appearance of a conventional swept wing jet aircraft, the proportional area relationships of the wing size to the horizontal stabilizer are modified and the positioning of the various components on the fuselage is closely controlled. The horizontal stabilizer is enlarged which provides a self-adjusting angle of attack and pitch control and permits the airplane kite to be flown in a wider range of wind speeds without mechanical adjustment to the strings or bridle lines.

The location of the leading edge of the wing on the fuselage is also important. It is located approximately one-fourth of the way back from the nose of the airplane kite compared to an approximate one-half distance location with an actual jet liner. Also, the wing is attached above the middle of the fuselage area thereby creating a long longitudinal keel at the lower fuselage area to improve lateral stability because the wings are void of dihedral.

The horizontal stabilizer of the airplane kite has about 50% more area compared to its wing area than the same dimensions of a conventional jet aircraft design. This increased area on the horizontal stabilizer enhances the kite's longitudinal attitude capability by automatically adjusting its angle of attack ideally for varying wind conditions, including slight breezes to stiff wind, without having to make adjustments to the bow string, bridle string or tail. The large vertical stabilizer enhances directional stability under all attitude angles of attack from very shallow to very steep angles.

Among the objects of the present invention are to provide a tethered aerodynamically sustained kite in the shape of a conventional jet liner which is stable under varying wind conditions, to provide a kite which is light in weight yet sturdy and durable in use, that is inexpensive to manufacture, has few parts, and is simple to assemble.

These and other objects of the present invention will become readily understood when taken in conjunction with the attached specification and drawings and as defined in the appended claims.

DESCRIPTION OF THE PREFERRED EMBODIMENTS

Figure 1:
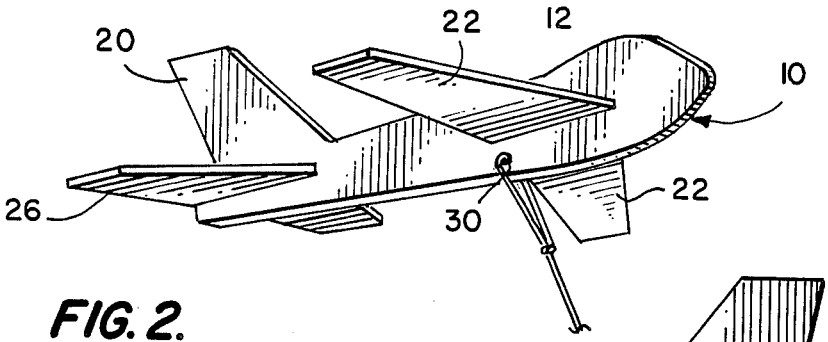
FIG. 1 is a perspective view of the airplane kite of the present invention.

Referring to the drawings, the airplane kite 10 of the present invention is formed of three members including a first body member 12 having a longitudinal fuselage 14, with a nose 16 and tail 18, and an integrally formed vertical stabilizer 20. The airplane kite 10 includes a wing member 22 which is adapted to fit into a slot 24 in the fuselage 14 and a horizontal stabilizer 26 adapted to fit in a second slot 28 at the tail 18 of the first body member 12.

It will be appreciated that the size of the airplane kite is not critical as long as the relative dimensions and locations of the various parts remain constant. In a preferred embodiment of the invention, the airplane kite is made of 11/16 inch expanded polystyrene flat sheet stock material. The fuselage 14 of the airplane kite 1 resembles the silhouette of a modern day jet liner having an overall length of 28 inches and a height of 13 inches. The overall wing span of the wing 22 is 28 inches with a wing root cord of 8 inches and a tip cord of 5 inches. The leading edge of the wing 22 is swept back 35 degrees, whereas the trailing edge of the wing 22 is swept back 25 degrees.

The horizontal stabilizer 26 has an overall span of 16 inches with a root cord of 6 inches and a tip cord of 3.25 inches. The leading edge of the horizontal stabilizer 26 is swept back 25 degrees while the trailing edge is swept back 13 degrees.

The slot 24 which receives the wing member 22 is placed in a forward position slightly above the longitudinal axis of the fuselage 14. The slot 24 is set to a 5 degree angle with respect to the longitudinal axis so that the wing 22 has a 5 degree angle of incidence with respect to the horizontal. The second slot 28 is located slightly above the longitudinal axis of the fuselage 14 to accommodate the horizontal stabilizer 26. A string 5 is attached at the pitch pivotal point 30 located forward of the center of gravity 32 and slightly forward of the midpoint of the fuselage between the nose 16 and tail 18.

Because of the location of the wing 22 in the slot 24 above the longitudinal axis, the fuselage portion below the wing from the nose to the tail forms a keel 34 which maximizes the longitudinal and lateral stability of the airplane kite 10.

Both the horizontal stabilizer 26 and the vertical stabilizer 20 are enlarged when viewed in silhouette, compared to the conventional design of a modern jet airplane, in order to provide both vertical and horizontal stability to the airplane kite 10.

Figure 2:
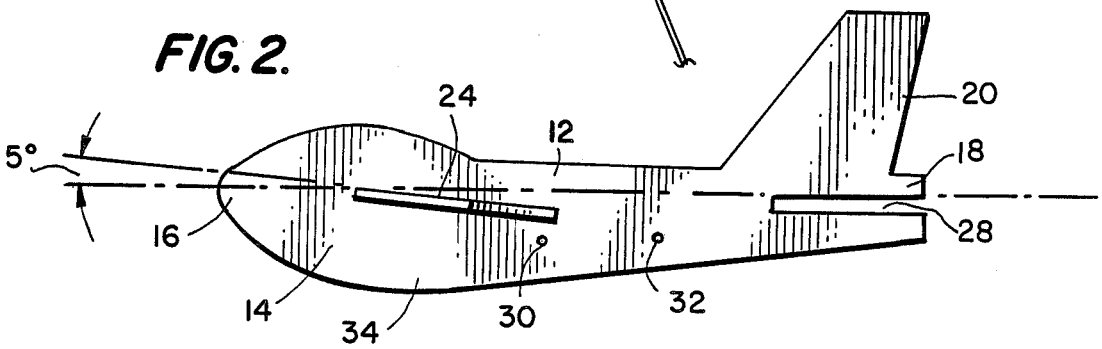
FIG. 2 is a side elevational view of the fuselage and vertical stabilizer section of the invention of FIG. 1.

As best seen from the side elevational view of FIG. 2, the vertical stabilizer 20 has an area which is preferably at least one-quarter of the total area of the first body member 12. The vertical stabilizer 20 also extends above the longitudinal axis, at least 80 percent of the maximum vertical distance of the body member 12 when viewed in side elevation. In the preferred embodiment, the vertical stabilizer 20 extends in a vertical direction more than one hundred percent of the maximum vertical dimension of the fuselage 14.

Figure 3:
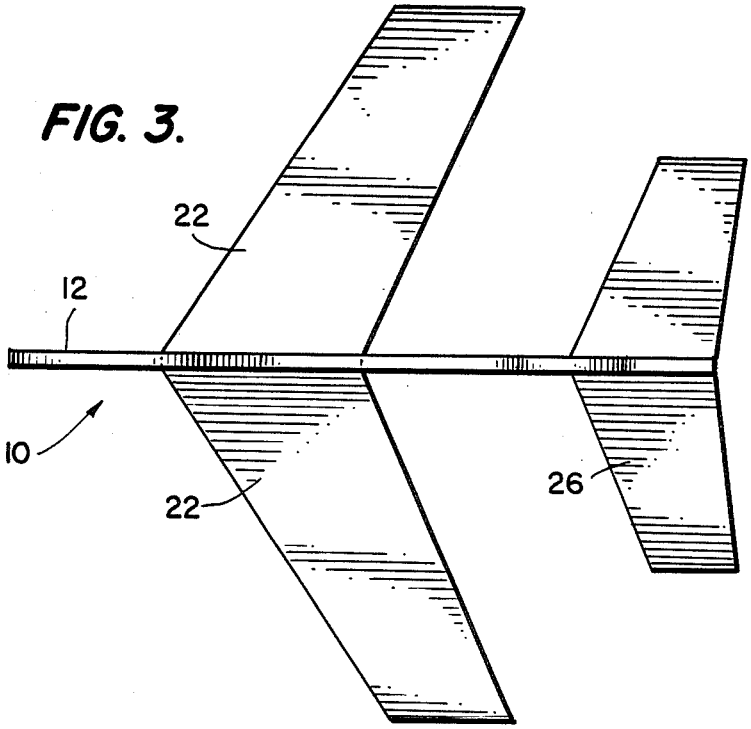
FIG. 3 is a top plan view of FIG. 1.
Figure 4:
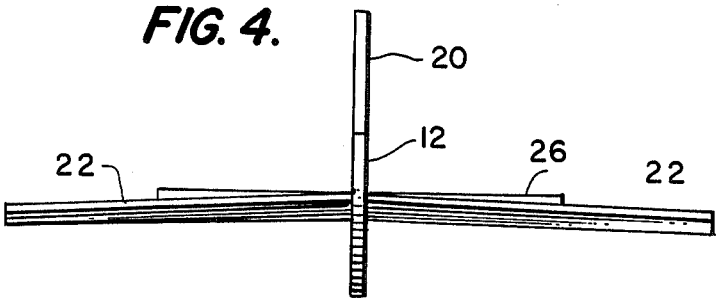
FIG. 4 is a front elevational view of FIG. 1.

As seen from the plan view of FIG. 3, the horizontal stabilizer 26 is enlarged and the total area of the horizontal stabilizer 26 is approximately at least 40 percent of the total area of the wing member 22.

The enlarged horizontal and vertical stabilizer structures provide increased wind bearing surface area which enables the airplane kite to stabilize itself during flying conditions.

The leading edge of the wing member 22 engages the fuselage at a point 23%, or approximately one-quarter the distance aft of the nose 16, and the center of gravity 32 falls at six-tenths the distance aft of the nose 16 of the body member 12. Further defining the location of the center of gravity, it is located rearwardly of the pitch pivotal point on the lateral axis of the wing at a distance behind the junction of the leading edge of the wing with the fuselage at a distance which is approximately 40 percent of the total length of the fuselage from nose to tail. These structural features, in combination with a large horizontal stabilizer 26 and pitch pivotal point 30 being slightly less than the midpoint between the nose 16 and the tail 18, or at 13 inches aft of the nose for a 28-inch-long model, permits the kite 10 to seek and adjust its angle of attack automatically to the wind conditions it encounters.

In other words, to establish both a permanent positive angle of attack into the wind and the ideal pitch angle for that particular wind velocity, which will vary from moment to moment, the kite string is attached at a predetermined pivotal point through a hole located in the keel 24 just forward of the center of gravity. Thus, the kite 10 is ideally designed to automatically adjust its pitch under varying wind conditions by pivoting at the point 30 where the string 5 is attached by the relative wind acting on the bottom surface area of the enlarged horizontal stabilizer 26. The positive angle of attack is always maintained because the kite string 5 is tethered forward of the center of gravity 32 causing it to be slightly tail heavy under all conditions.

In use, the kite is placed downwind on its keel with the nose facing into the wind. Pulling the tether string form an upwind position will cause the kite to take off like an airplane and climb skyward when pulled a few feet into the wind. The string may be then let out as desired to fly the airplane kite at various heights above the ground. Because of the inherent design characteristics of the airplane kite, the kite will perform well in both light breezes or stiff winds because it is self-adjusting and maximizes longitudinal and lateral stability. The kite will attain a greater height than most other kites with the same length of string because of a greater angle achieved from the kite flyer to the kite. The kite resembles a conventional jet plane, and therefore, provides greater pleasure to the user than with a conventional kite structure.

It will be appreciated that although the airplane kite has been described with reference to a specific embodiment, the invention shown and described in detail may include various changes and modifications without departing from the spirit and scope of the invention as defined by the appended claims.

I claim:

1. A tethered airplane kite in a form to resemble a jet powered airplane, comprising:

a body member, in elevation defining a longitudinal fuselage with a nose and tail, and a vertical stabilizer;

a wing member, in plan, having swept back leading and trailing edges;

and, a horizontal stabilizer, in plan, having swept back leading and trailing edges;

said kite apparatus being characterized with its lateral axis through said wing member, having a pitch pivotal point located on said lateral axis and a center of gravity located rearwardly of said pitch pivotal point, creating a pitch-up orientation in the wind;

said body member having a first slot opening adapted to receive said wing member; said slot opening beginning at a point located approximately one-quarter the length of the fuselage aft of said nose and extending rearwardly therefrom;

said tethered airplane kite being further characterized by said vertical stabilizer projecting above the longitudinal axis of said body member a distance equal to at least three-quarters of the maximum vertical dimension of said fuselage of said body member; said vertical stabilizer having an area of at least one-quarter of the total area of said body member; and said horizontal stabilizer having an area of at least one-third of the area of said wing member.

2. The tethered airplane kite of claim 1 further characterized by said center of gravity being located behind the junction of said leading edge of said wing member and said fuselage at a distance behind said junction which is approximately 40 percent of the total length of said longitudinal fuselage between said nose and said tail.

3. The airplane kite of claim 1 wherein said wing member, has a leading edge swept back 35 degrees.

4. The airplane kite of claim 3 wherein said wing member has a trailing edge swept back 25 degrees.

5. The airplane kite of claim 1 wherein said horizontal stabilizer has a leading edge swept back 25 degrees.

6. The airplane kite of claim 3 wherein said horizontal stabilizer has a trailing edge swept back 13 degrees.

7. The airplane kite of claim 1 wherein said wing member has an angle of incidence of 5 degrees with respect to the axis of said longitudinal fuselage.

8. The airplane kite of claim 1 further including a keel section located on said fuselage below the axis of said longitudinal fuselage.

9. The airplane kite of claim 1 wherein said body member, said wing member and said horizontal stabilizer consist of flat sheet stock material.

10. The airplane kite of claim 9 wherein said flat sheet stock material is expanded plastic foam.

* * * * *